US006390961B1

(12) United States Patent
Nakada et al.

(10) Patent No.: US 6,390,961 B1
(45) Date of Patent: May 21, 2002

(54) SEMICONDUCTIVE SILICONE RUBBER ROLLER

(75) Inventors: Kazuya Nakada; Tsuneo Ohki; Fusao Yomoda, all of Saitama-ken (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 2 days.

(21) Appl. No.: 09/589,205

(22) Filed: Jun. 8, 2000

(30) Foreign Application Priority Data

Jun. 9, 1999 (JP) ..... 11-162757

(51) Int. Cl.[7] ..... B25F 5/02
(52) U.S. Cl. ..... 492/56; 492/53; 492/49
(58) Field of Search ..... 492/56, 54, 18, 492/53, 49, 59; 399/174, 176, 115, 313

(56) References Cited

U.S. PATENT DOCUMENTS 5,089,851 A * 2/1992 Tanaka et al. ..... 355/219
5,292,603 A * 3/1994 Sakai et al. ..... 430/18
5,363,180 A * 11/1994 Shimizu et al. ..... 355/285
5,485,344 A * 1/1996 Matsumoto et al. ..... 361/225
5,508,138 A * 4/1996 Shimizu et al. ..... 430/99
5,519,479 A * 5/1996 Shimizu et al. ..... 355/285
5,649,273 A * 7/1997 Shimizu et al. ..... 399/329
5,751,801 A * 5/1998 Murata et al. ..... 399/176
5,822,658 A * 10/1998 Tanaka et al. ..... 399/174
5,827,160 A * 10/1998 Ohki et al. ..... 492/56
5,925,893 A * 7/1999 Ishii et al. ..... 257/40
6,190,295 B1 * 2/2001 Kawano et al. ..... 492/56
6,203,855 B1 * 3/2001 Tarnawskyj et al. ..... 427/385.5

* cited by examiner

*Primary Examiner*—I Cuda Rosenbaum
(74) *Attorney, Agent, or Firm*—Wenderoth, Lind & Ponack, L.L.P.

(57) ABSTRACT

Disclosed is a semiconductive rubber roller used as a developing roller in a photocopying printer machine exhibiting excellent performance and outstanding durability. The rubber roller is an integral body comprising (a) a shaft of a metallic material, (b) a base rubber layer on and around the shaft formed from a semiconductive silicone rubber having a specified volume resistivity and (c) a cladding layer having a specified thickness on and around the base rubber layer formed from a synthetic resin composition compounded with a specified amount of particles of a dielectric material, such as silica, having a dielectric constant of 2.0 to 8.0 and a specified average particle diameter.

9 Claims, 1 Drawing Sheet

SEMICONDUCTIVE SILICONE RUBBER ROLLER

BACKGROUND OF THE INVENTION

The present invention relates to a semiconductive silicone rubber roller for office instruments utilizing a photocopying unit used around the photosensitive drums or, in particular, as a developing roller having a surface covering layer exhibiting good balance between anti-wearing resistance and electrostatic chargeability which retains the initial developing performance over a long service life.

In the electrostatic recording instruments such as copying machines, laserbeam printers, facsimile machines and the like among office-automation instruments working as a type of photocopier, the step of image development is conducted in the following manner. A thin layer of a triboelectrically chargeable toner formed on a developing rubber roller is brought into contact with a photosensitive body to effect development of a latent image on the photosensitive body. The toner particles are charged with static electricity of a specified level by means of the triboelectric charging mainly between the toner particles and the developing roller and between the toner particles and a developing blade and, after adjustment of the thickness of the toner layer by the developing blade press-contacted with the developing roller, transferred onto the surface of the photosensitive body and deposited by the electrostatic force on the electrostatic latent image formed on the photosensitive body to exhibit a visible image. The requirements for the properties of the developing roller include excellent durability for long-term service, appropriate surface roughness, uniform thickness of the toner layer formed thereby, stability in electrostatic charging behavior and so on.

One of the criteria for the evaluation of the durability of the developing roller is given by the occurrence of scratches formed on the surface of the roller after service over a long term. In addition to direct rubbing with the toner particles, scratches are also possibly formed by rubbing with the toner particles bonded to the surface of the blade. Since the thickness of the toner layer on the developing roller is about 20 to 30 $\mu$m, scratches formed on the surface of the roller, even when the depth thereof is very small, 4 to 5 $\mu$m, locally affect the surface roughness and electrostatic charging characteristics. This leads to troubles relative to the quality of the developed images, such as fogging and the appearance of white voids. Accordingly, it is important that the material of the surface-covering layer of the developing roller satisfies the requirements for the stability of the outer diameter of the roller, surface roughness and electrostatic charging characteristics.

Further, the developing roller plays a role for triboelectric charging of the toner particles coming into contact with the roller surface. In the triboelectric charging of two different materials of different natures, the surfaces of the materials after contacting and separating are charged with electrostatic charges of equal quantity but of different signs. The sign of the charges, which may be positive or negative on one and negative or positive on the other, is determined by the relative natures of the two materials or so-called contact-electrification ranks of the materials. The charging capacity of the materials is determined by the electrostatic capacity inherent in the respective materials. Since the condition of electrostatic charging depends on the relative natures of the contacting two materials, the charging characteristics, e.g., sign of charges, quantity of charging, stability of charging, etc., of one of the contacting materials have great influence on the charging characteristics of the other. Namely, the charging characteristics of the developing roller are deeply correlated with the charging quantity of the triboelectrically chargeable toner particles, thickness of the toner layer, toner consumption and toner releasability within the developing unit and with the full-black density, i.e. Macbeth density, occurrence of fogging and voids on the actually printed images. It is therefore important to select a rubbery material for the surface layer of the roller capable of keeping constancy of the quantity of electrostatic charges in relation to the selection of the filler, compounding technology and preparation and coating technology of the coating composition.

It is conventional that the surface layer of developing rollers is formed from a silicone rubber by virtue of the excellent and advantageous properties thereof. For example, silicone rubbers exhibit, as compared with other types of rubbery materials, stable elasticity over a long period with excellent weatherability to withstand adverse environmental conditions. A sharp charge distribution of triboelectrically charged toner particles can be obtained on a roller surface made from a silicone rubber. Further, the roller surface of a silicone rubber has a low susceptibility to the occurrence of filming by the toner particles. Even with these advantageous properties of a silicone rubber-made developing roller, troubles have been encountered in recent years such as the occurrence of fogging and insufficient printing density caused by repeated printing along with the trend toward higher and higher printing velocity necessitating an increase in the load on the developing rollers. These troubles are caused presumably by the streaky scratches running around the circumference of the developing rollers and an eventual change in the surface roughness.

Though advantageous as a material of developing rollers as is described above, silicone rubbers are generally not quite satisfactory in respect of their abrasion resistance. According to the results of a running test by using a machine for actual service, some of the silicone rubber rollers after long-term service or after expiration of the cartridge life, exhibited a decrease in the outer diameter of the roller due to wearing of the surface and a decrease or increase in the surface roughness along with changes in the electrostatic charging characteristics.

In view of the above mentioned defects of silicone rubbers, proposals were made for the use of a urethane rubber having superior mechanical properties as a material of developing rollers as compared with silicone rubbers. Urethane rubber-made developing rollers, however, have problems caused by changes in their elastic modulus and electric properties such as volume resistivity in long-term service because urethane rubbers are subject to a hydrolysis reaction with moisture.

The development work for the developing rollers in recent years has been directed to these problems, in compliance with the requirement for upgrading the image quality which can be accomplished by further and further decreasing the thickness of the toner layer on the surface of the developing roller, to minimize changes in the developing characteristics due to the instability of the physical and morphological conditions of the roller surface.

It is now understood that the above mentioned problems can hardly be solved with an elastic roller formed from a single rubbery material. Accordingly, it is eagerly desired to develop a developing roller of the separate-function type comprising an elastic base layer on and around a shaft made from a rubbery material having high stability over a long time of its elastic modulus and volume resistivity and a cladding layer formed thereon from a material having excellent abrasion resistance and moderate charging characteristics in combination which is imparted with desirable electrostatic charging characteristics by compounding with a dielectric filler.

SUMMARY OF THE INVENTION

The present invention accordingly has an object to provide an improved developing roller for a photocopying unit having a composite structure of the rubber portion comprising of a base layer on a metallic shaft made from a rubber having high resistance to withstand adverse environmental conditions and a cladding layer thereon formed from an elastic material having a well balanced combination of abrasion resistance and electrostatic charging characteristics so that the initial high performance for image development can be lastingly retained over a long time.

Thus, the developing roller provided by the present invention is an integral body which comprises:

(a) a shaft made from an electroconductive material such as a metal;

(b) a base layer of a semiconductive silicone rubber formed on and around the shaft; and (c) a cladding layer of a synthetic resin composition containing dielectric particles dispersed therein formed on and around the base layer, the synthetic resin being selected from urethane resins and acrylic melamine resins.

In particular, the dielectric particles are positively polarizable and the material of the dielectric particles preferably has a dielectric constant in the range from 2.0 to 8.0.

DETAILED DESCRIPTION OF THE PREFERRED EMBODIMENTS

As is described above, the inventive rubber roller for development of a photocopying image is an integral body having a composite structure comprising (a) a shaft of an electroconductive material or, typically, a metal, (b) a base rubber layer on and around the shaft formed from a semiconductive silicone rubber and (c) a cladding layer on and around the base rubber layer formed from a synthetic resin composition compounded with dielectric particles having a specified dielectric constant.

Figure 1A:
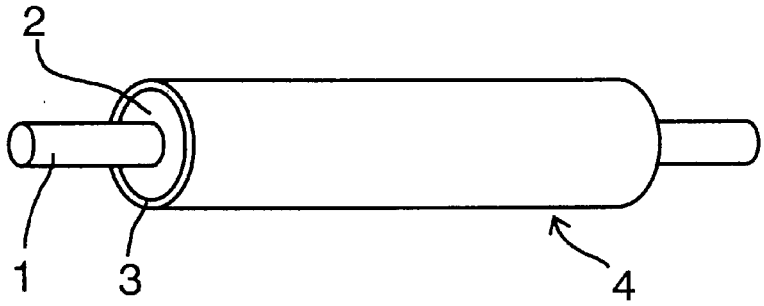
FIGS. 1A and 1B are a perspective view and a radial cross sectional view, respectively, of the inventive semiconductive silicone rubber roller.
Figure 1B:
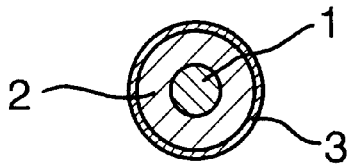

In the following, the inventive semiconductive rubber roller is described in detail by making reference to FIGS. 1A and 1B of the accompanying drawings which illustrate a perspective view and radial cross sectional view, respectively, of a typical example of the inventive roller. The rubber roller 4 has a composite structure comprising (a) a shaft 1 of an electroconductive or metallic material, (b) a base rubber layer 2 formed from a semiconductive silicone rubber and (c) a clad-cladding layer 3 formed from a synthetic resin composition compounded with dielectric particles.

The electroconductive material of the shaft 1 can be selected from a variety of metallic materials including steels, aluminum, stainless steels, brass and the like. Besides, the shaft 1 can be formed from a mandrel of a thermoplastic or thermosetting resin provided with a metallic plating layer on the surface or from a mandrel of an electroconductive resinous composition based on a thermoplastic or thermosetting resin compounded with a conductivity-imparting powder such as carbon black, metal powders and the like. When the instrument is in operation, the shaft 1 is grounded or a bias voltage is applied thereto so as to serve for charging of the electrostatic latent image carrier, charge injection to the toner particles, adsorption of the toner particles, development of the latent image by the transfer of the toner particles to the electrostatic latent image carrier and so on.

The base rubber layer 2 is formed on and around the shaft 1 from a semiconductive silicone rubber composition which is prepared by compounding an organopolysiloxane gum such as dimethyl silicone gums, methyl phenyl silicone gums and the like either singly or as a blend of two kinds or more with a reinforcing silica filler such as finely divided fumed silica powders and precipitated silica powders and further with an appropriate amount of an electroconductive powder including electroconductive carbon black, powders of a metal such as nickel, aluminum, copper and the like, as well as electroconductive metal oxides such as zinc oxide, tin oxide and the like, and powders of an insulating material such as barium sulfate, titanium dioxide, potassium titanate and the like of which the particles are coated with a conductive material either singly or as a combination of two kinds or more as an electroconductivity-imparting agent in an appropriate compounding amount. The silicone rubber composition is imparted with vulcanizability by compounding with a curing agent in an effective amount.

The semiconductive silicone rubber here implied has a volume resistivity in the range from $10^3$ to $10^9$ ohm·cm.

The loading amount of the reinforcing silica filler in the silicone rubber composition for the formation of the semiconductive base rubber layer 2 of the inventive roller 4 is usually in the range from 10 to 30 parts by weight per 100 parts by weight of the organopolysiloxane gum. When the amount of the reinforcing silica filler is too small, the mechanical strength of the base silicone rubber layer 2 after curing in not high enough. When the amount of the filler is too large, on the other hand, the silicone rubber composition suffers a decrease in moldability and workability with an increase in brittleness.

The amount of the electroconductivity-imparting agent added to the silicone rubber composition is, when it is an acetylene black or a high-conductive furnace black, in the range from 1 to 15 parts by weight per 100 parts by weight of the silicone rubber composition to have a sufficiently high electroconductivity.

The curing agent compounded in the silicone rubber composition can be an organic peroxide compound exemplified by benzoyl peroxide, bis-2,4-dichlorobenzoyl peroxide, dicumyl peroxide, di-tert-butyl peroxide, 2,5-dimethyl-2,5-bis(tert-butylperoxy) hexane and the like. When molecules of the organopolysiloxane gum have vinyl groups bonded to the silicon atoms, the curing agent can be a combination of an organohydrogenpolysiloxane having at least two silicon-bonded hydrogen atoms and a catalytic amount of a platinum compound as a catalyst for the hydrosilation reaction.

The compounding work of the above described various ingredients can be performed by using known rubber processing machines such as pressurizable kneaders, Banbury mixers, mixing rollers, planetary mixers and the like.

The method for shaping of the base rubber layer 2 on and around the shaft 1 is not particularly limited and any one of conventional molding methods can be applied, including a method of compression molding in which the silicone rubber composition surrounding the shaft 1 is compression-molded at an elevated temperature in a metal mold, a method of extrusion molding-curing in which the semiconductive silicone rubber composition is extruded with the shaft 1 by using a crosshead on an extruder machine followed by a primary curing treatment in a Geer oven or an infrared oven, a method of injection molding in which the shaft 1 is set in a metal mold into which the silicone rubber composition is introduced by injection to be heated therein, and so on. The silicone rubber layer after the primary curing in the above described methods is then desirably subjected to a secondary curing treatment in a hot air oven at a temperature of 100 to 200° C.

When a semiconductive silicone rubber layer having a lower elastic modulus is desired for the base layer 2, a layer of a foamed silicone rubber can be prepared by compounding the silicone rubber composition with an organic blowing agent followed by heating of the composition to effect foaming and formation of a skin layer of a nonfoamed rubber thereon. The organic blowing agent suitable for this purpose includes azobisisobutyronitrile and azodicarboxylic acid amide. The amount of the organic blowing agent compounded in the silicone rubber composition is usually in the range from 0.5 to 5 parts by weight per 100 parts by weight of the silicone rubber composition. When the amount of the blowing agent is too small, a foamed silicone rubber with appropriate expansion cannot be obtained as a matter of course while, when the amount of the blowing agent is too large, the foamed silicone rubber has an unduly decreased mechanical strength due to excessive expansion. The base rubber layer 2 of a foamed silicone rubber composition is formed preferably by the extrusion molding method mentioned above because the molding step is conducted at room temperature to avoid premature foaming of the rubber composition and to effect foaming under easily controllable conditions. In contrast thereto, the injection molding and compression molding require good control of the molding temperature so that difficulties are encountered in obtaining foamed base rubber layers with high reproducibility.

The intermediate after formation of the base rubber layer 2 of a semiconductive silicone rubber composition on and around the conductive shaft 1 is then subjected to cylindrical surface grinding by using a cylindrical grinder, shot blaster, sand blaster, lapping machine, buffing machine and the like followed by. the formation of the cladding layer 3 from a synthetic resin composition compounded with dielectric particles. It is sometimes advantageous to apply a primer to the surface of the semiconductive base rubber layer 2 or to irradiate the surface with ultraviolet light with an object to increase the bonding strength between the surface of the base rubber layer 2 and the cladding layer 3 thereon. The method for the formation of the cladding layer 3 is not particularly limited depending on the nature of the resin composition for the cladding layer 3. When the resin composition is in the form of a liquid coating composition prepared by dissolving the resin and dispersing the dielectric particles in a suitable organic solvent, the surface of the base rubber layer 2 is coated with the coating liquid composition by spraying or dipping. When the resin composition is in the form of a heat-shrinkable tube, the base rubber layer 2 is covered by the heat-shrinkable tube followed by thermal shrinking of the tube.

The synthetic resin for the cladding layer 2 can be selected from a variety of synthetic resins, including acrylic melamine resins, urethane resins and the like. The acrylic melamine resin above mentioned is a melamine-crosslinked copolymeric resin of acrylic acid with an acrylic acid ester, acrylamide and/or acrylonitrile.

The urethane resin is a resin obtained by the reaction of a polyether polyol or a polyester polyol with an aromatic or aliphatic polyisocyanate compound and available in the form suitable for the preparation of a coating composition by dissolving or dispersing in an organic solvent or in the self-emulsifiable form suitable for the preparation of a water-base coating composition by introducing hydrophilic functional groups onto the urethane skeleton of the resin.

The above mentioned polyether polyol is exemplified by polypropyleneglycols and polytetramethylene ether glycols. The polyester polyol is exemplified by polycaprolactones and polycarbonate polyols.

The aromatic polyisocyanate compound is exemplified by tolylene diisocyanate, diphenylmethane diisocyanate, polymethylene polyphenyl polyisocyanate, tolidine diisocyanate and naphthalene diisocyanate. The aliphatic polyisocyanate compound is exemplified by hexamethylene diisocyanate, isophorone diisocyanate, hydrogenated xylene diisocyanate, dimeric acid diisocyanate, tetramethylhexamethylene diisocyanate and lysine diisocyanate methyl ester.

The dielectric particles compounded in the above described synthetic resin include positively polarizable particles of a dielectric material such as spherical silica particles, diatomaceous earth and crystalline silica particles. Particles of azine compounds as a class of organic dielectric material can also be used. It is preferable that the dielectric material of the particles has a dielectric constant in the range from 2.0 to 8.0. When the dielectric constant is too low, a sufficiently large electrostatic capacity required for charging can hardly be obtained unless the compounding amount of the dielectric particles is increased to be large. When the dielectric constant is too high, on the other hand, the electric charges are strongly retained within the cladding layer 3 so that transfer of the toner particles to the electrostatic latent image on the photosensitive drum is disturbed, resulting in eventual trouble caused by voids in the photocopied image.

The dielectric particles should desirably have an average particle diameter in the range from 0.1 to 30 $\mu$m. When the particles are too fine, complete dispersion of the particles can hardly be obtained due to agglomeration of the particles which gives rise to charging characteristics that are not uniform. This leads to a risk of dielectric breakdown in the cladding layer 3 due to localization of electrostatic charges. When the particles are too coarse, on the other hand, it is sometimes the case that the particles settle within the cladding layer by the weight of the particles per se resulting in a decrease in the distribution density of the particles on the surface of the cladding layer 3 so that the contribution of the dielectric particles exposed on the roller surface to the charging characteristics of the roller surface is unduly decreased.

The compounding amount of the dielectric particles in the resin composition for the cladding layer 3 is preferably in the range from 5 to 60 parts by weight per 100 parts by weight of the synthetic resin although the amount naturally depends on various factors such as particle diameter and specific surface area of the dielectric particles. When the compounding amount of the dielectric particles is too small, the density of the particles exposed on the roller surface is so low that improvement in the charging characteristics can hardly be obtained. A compounding amount of the dielectric particles that is too large, on the other hand, may lead to a decrease in the mechanical surface strength of the cladding layer 3.

It is possible to accomplish fine adjustment of the charging characteristics by the admixture of the synthetic resin composition for the cladding layer 3 with a charge controlling agent such as Nigrosine Base azine compounds, resin-modified azine compounds, quaternary ammonium salt compounds and the like having an average particle diameter of 0:1 to 30 $\mu$m in an amount of 5 to 20 parts by weight per 100 parts by weight of the synthetic resin.

The thickness of the cladding layer 3 formed on and around the base rubber layer 2 is preferably in the range from 5 to 100 $\mu$m. When the thickness is too small, the mechanical strength of the cladding layer 3 is low resulting in eventual falling of the layer 3 and uneven charging of the toner particles so that the image quality of the photocopy is poor with fogging and voids. When the thickness of the layer 3 is too large, on the other hand, this leads to uneven charging of the toner particles and a decrease in the elasticity of the surface so that the toner particles are sometimes damaged. The charging quantity of toner particles, which means the electrostatic charges per unit weight of the toner particles, i.e. Q/M, should preferably be in the range from 0.01 to 20 $\mu$C/g. When the value of Q/M is too large, the bonding and transfer would be too strong resulting in the troubles of fogging while, when the value of Q/M is too small, photocopied images suffer a defect of voids due to insufficient bonding strength of the toner particles.

The durability of the semiconductive silicone rubber roller 4 of the present invention can be estimated by comparing various parameters at the initial stage with those after prolonged service. For example, the decrease in the outer diameter of the roller 4 should not exceed 0.01 mm in order to be used for further service. The surface roughness of the roller after prolonged use should be in the range from 0.5 to 2 times of the initial value. The electric resistance between the conductive shaft 1 and the roller surface after prolonged use should be in the range from 0.1 to 10 times of the initial value. The charge quantity of toner particles after prolonged use should be in the range from 0.5 to 2.5 times of the initial value. When any one of these parameters after prolonged use does not fall within the above mentioned range, the quality of the photocopy is decreased with occurrences of fogging, blur, voids and the like, as the number of photo copying is further increased. The above mentioned "prolonged use" of the developing roller means 5000 occurrences of photocopy printing by using a 5% duty pattern on a photocopying printer machine.

In the following, the semiconductive silicone rubber roller of the present invention is described in more detail by way of Examples and Comparative Examples, which, however, do not limit the scope of the invention in any way.

EXAMPLE 1

The electroconductive shaft 1 used as the core mandrel of the rubber roller 4 was a rod of SUS 22 grade stainless steel having a diameter of 10 mm and a length of 400 mm and provided with a plating layer of nickel having a thickness of 3 to 5 $\mu$m. The shaft 1 was coated with a silicone-based primer (No. 23, a product by Shin-Etsu Chemical Co.) followed by a baking treatment in a Geer oven at 150° C. for 10 minutes.

Separately, a semiconductive silicone rubber composition was prepared by uniformly blending 100 parts by weight of an organic peroxide-curable organopolysiloxane gum (KE 78VB, a product by ShinEtsu Chemical Co.) with 10 parts by weight of a carbon black (Thermal Black, a product by Asahi Carbon Co.) and 25 parts by weight of a fumed silica filler (Aerosil 200, a product by Nippon Aerosil Co.) in a pressurizable kneader followed by further addition of 2.0 parts by weight of an organic peroxide-based curing agent for silicone rubbers (C-8, a product by Shin-Etsu Chemical Co.).

The thus prepared semiconductive silicone rubber composition was compression-molded around the shaft 1 in a metal mold having a cylindrical cavity of 20 mm diameter at 175° C. for 10 minutes followed by a secondary curing treatment in a Geer oven at 200° C. for 7 hours to form a base rubber layer on and around the shaft 1 which was firmly bonded to form a cured silicone rubber layer. Thereafter, the surface of the semiconductive rubber layer was ground on a cylindrical grinder machine to finish a semiconductive base rubber layer 2 having an outer diameter of 18 mm and a length of 320 mm.

Further separately, a resin composition for a cladding layer 3 was prepared by compounding 100 parts by weight of an acrylic melamine coating composition as a melamine-crosslinked polymer of a methacrylic acid ester with 5 parts by weight of dielectric particles of an azine compound having a dielectric constant of 5.5 (Bontron N-01, a product by Orient Chemical Industry Co.), of which the average particle diameter was 10 to 15 $\mu$m. This resin composition was applied by spraying to the surface of the semiconductive base rubber layer 2 after coating with a primer (Primer C, a product by Shin-Etsu Chemical Co.) to form a layer of 20 $\mu$m thickness followed by a heat treatment at 200° C. for 30 minutes to effect drying and curing of the layer and to obtain a semiconductive silicone rubber roller 4 having a cladding layer 3.

The thus prepared semiconductive silicone rubber roller 4 was subjected to the measurements of the initial values of the parameters including:

the outer diameter $r_0$, mm, surface roughness $Rz_0$, electric resistance $R_0$, ohm, and charging of toner particles $T_0$, $\mu$C/g, and the corresponding values after service running on an actual photocopying machine for printing of 5000 copies under the conditions of 12 ppm and intermittent 5% printing including:

the outer diameter $r_1$, surface roughness $Rz_1$, electric resistance $R_1$ and charging of toner particles $T_1$, to give the results shown in Table 1 below.

The conditions for the measurements and the evaluation criteria were as follows.

(1) Outer Diameter ($r_0$–$r_1$)

Measurements were made by using a laser instrument (Model Laser Scan Micrometer LSM-1610, manufactured by Mitsutoyo Co.) at three points of the rotating roller including the center point of the 320 mm length and two points 10 mm apart from the end surfaces of the rubber portion. When the absolute value of ($r_o$–$r_1$) did not exceed 0.01 mm, the roller was evaluated as acceptable.

(2) Surface Roughness ($Rz_1/Rz_0$)

Measurements were made by using a roughness tester (Model Surfcom 590A, manufactured by Tokyo Seimitsu Co.) at 10 points of regular intervals along the lengthwise direction on the roller surface. When the value of $Rz_1/Rz_0$ was in the range from 0.5 to 2.0, the roller was evaluated as acceptable.

(3) Electric Resistance ($R_1/R_0$)

Figure 2:
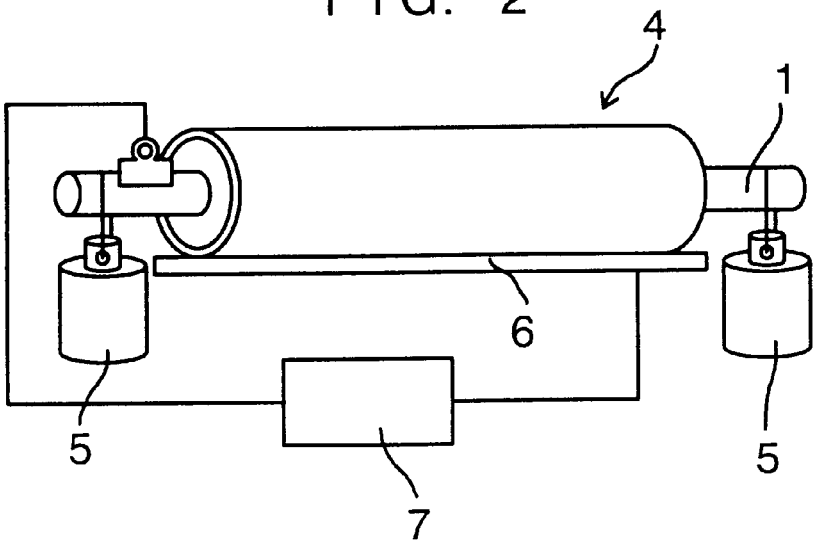
FIG. 2 shows a wiring diagram of the system for the measurement of the electric resistance between the metallic shaft and the surface of the semiconductive rubber roller.

The semiconductive rubber roller 4 was mounted on the electrode plate 6 of the measuring device illustrated in FIG. 2 with two 500 g weights 5,5 each hanging on the end portion of the metallic shaft 1 to push the roller surface against the electrode plate 6 and the resistance between the metallic shaft 1 and the electrode plate 6 was determined by using a resistance meter 7 (Model Advantest R8340A Ultra High Resistance Meter, manufactured by Advantest Co.) with application of a DC voltage of 500 volts. When the value of $R_1/R_0$ was in the range from 0.1 to 10, the roller was evaluated as acceptable.

(4) Toner Charging Q/M ($T_1/T_0$)

The rubber roller under testing was set on a development unit and rotated for 5 minutes at a peripheral velocity of 100 mm/second. Immediately thereafter, a 2 cm by 2 cm square piece of a mending tape was attached to the roller surface and the surface potential of the roller surface was measured at the area where the toner particles had been removed by the mending tape and at the area where the toner particles are left deposited by using a surface electrometer (Trek Model 344 with a probe 6000B-70, manufactured by Trek Co.).

Measurements were performed by keeping the probe end at a distance of 4 mm from the roller surface and the value obtained after 10 seconds from the start of measurement was taken as the surface potential. Calculation of Q/M was made from the potential difference V between the two areas without and with the toner particles by utilizing the equation given below. The rubber roller was evaluated as acceptable when the value of $T_1/T_0$ was in the range from 0.5 to 2.5:

$$Q/M,\ \mu C/g=(2\in^{*}V/\rho d^{2})\times 10^{12}=0.2836V/M^{2},$$

where $\rho$ is the bulk density of the toner particles, g/cm$^3$, $\in_1$ is the specific dielectric constant of the toner, $\in_0$ is the vacuum dielectric constant, i.e. $8.85\times10^{-12}$, F/m, $\in^{*1}$ is the apparent specific dielectric constant, i.e. $10^{-}(\rho/1.1\times\log\in_1)$, $\in^{*}$is the apparent dielectric constant, F/m=$\in_0\times\in^{*1}$, d is the thickness of the toner layer, $\mu$m,=M/$\rho\times10$ V is the surface potential, volts, with the shaft set, and M is the amount of toner deposited, mg/cm$^2$.

(5) Macbeth Density of Black Mass, Initial and After Long-term Service

A continuous printing test of 5000 copies was conducted on a photocopying printer by using a 5% duty pattern for continuous printing and printing of a set of patterns for evaluation was conducted at the moments when printings of the 5th copy (initial) and 5000th copy (after long-term service) were completed. The black mass Macbeth density was determined for each of the test patterns by using a Macbeth densitometer. The rubber roller was evaluated as acceptable when the value of the Macbeth density was 1.3 or larger.

(6) Fogging Points, Initial and After Long-term Service

A continuous printing test of 5000 copies was conducted in the same manner as above. Fogging points were determined on each of the evaluation patterns within a 0.5 mm by 1 mm white area below the black mass by using a CCD camera of 200 magnifications. The rubber roller was evaluated as acceptable when the number did not exceed 15.

(7) Full-black Follow-up, Initial and After Long-term Service

The copies prepared by the test photocopy printing in the same manner as above were subjected to the measurement of the Macbeth density of the full black image for 6 points corresponding to 6 revolutions of the roller and the ratio of the densities at the first point and sixth point was calculated. The rubber roller was evaluated as acceptable when this ratio was 0.98 or larger.

EXAMPLE 2

The experimental procedure was substantially the same as in Example 1 except for the replacement of 5 parts by weight of the dielectric particles (Bontron N-01) added to the acrylic melamine resin-based coating composition for the cladding layer 3 with 10 parts by weight of another grade of dielectric silica particles (Oplite) having a dielectric constant of 4.0, of which the average particle diameter was 10 to 15 $\mu$m. Table 1 shows the results of the evaluation tests for this rubber roller undertaken in the same manner as in Example 1.

EXAMPLE 3

The experimental procedure was substantially the same as in Example 1 except for the replacement of the acrylic melamine resin-based coating composition for the cladding layer 3 with a urethane resin-based coating composition (Altipaworld, a product by Musashi Toryo Co.). Table 1 shows the results of the evaluation tests for this rubber roller undertaken in the same manner as in Example 1.

Comparative Example 1

The experimental procedure was substantially the same as in Example 1 except for the replacement of the acrylic melamine resin-based coating composition for the cladding layer 3 with a styrene-acrylic resin (CPR 100, a product by Mitsui Chemical Co.). Table 1 shows the results of the evaluation tests for this rubber roller undertaken in the same manner as in Example 1. As is understood from this table, the rubber roller was evaluated as unacceptable in respect to the black mass Macbeth density after long-term service, fogging points and full-black follow-up.

Comparative Example 2

The experimental procedure was substantially the same as in Example 1 except for the replacement of the acrylic melamine resin-based coating composition for the cladding layer 3 with a silicone-based coating composition (KP 801M, a product by Shin-Etsu Chemical Co.). Table 1 shows the results of the evaluation tests for this rubber roller undertaken in the same manner as in Example 1. As is understood from this table, the rubber roller was evaluated as unacceptable in respect of the fogging points.

TABLE 1

| | Example 1 | Example 2 | Example 3 | Comparative Example 1 | Comparative Example 2 |
|---|---|---|---|---|---|
| $r_1 - r_0$ | −0.005 | −0.008 | −0.003 | −0.016 | −0.014 |
| $Rz_1/Rz_0$ | 1.6 | 1.8 | 1.5 | 0.8 | 2.2 |
| $R_1/R_0$ | 4.1 | 7.1 | 7.6 | 0.07 | 0.15 |
| $T_1/T_0$ | 0.7 | 0.9 | 1.2 | 1.9 | 2.0 |

TABLE 1-continued

| | | Example 1 | Example 2 | Example 3 | Comparative Example 1 | Comparative Example 2 |
|---|---|---|---|---|---|---|
| Macbeth density in black mass | initial | 1.32 | 1.40 | 1.31 | 1.38 | 1.42 |
| | after service | 1.35 | 1.38 | 1.34 | 1.20 | 1.45 |
| Fogging points | initial | 6 | 10 | 7 | 25 | 18 |
| | after service | 8 | 14 | 10 | 31 | 24 |
| Full-black follow-up | initial | 0.99 | 0.98 | 0.98 | 0.89 | 0.98 |
| | after service | 0.99 | 0.98 | 0.98 | 0.95 | 0.98 |

What is claimed is:

1. A semiconductive rubber roller having an integral body, said semiconductive rubber roller comprising:

a shaft made from an electrically conductive material;

a base rubber layer formed on and around said shaft from a semiconductive silicone rubber; and a cladding layer formed on and around said base rubber layer from a synthetic resin-based composition containing particles of a dielectric material.

2. The semiconductive rubber roller as claimed in, claim 1, wherein said particles of said dielectric material are positively polarizable and said dielectric material has a dielectric constant in the range from 2.0 to 8.0.

3. The semiconductive rubber roller as claimed in claim 1, wherein said electrically conductive material forming said shaft is a metallic material.

4. The semiconductive rubber roller as claimed in claim 1, wherein said semiconductive silicone rubber has a volume resistivity in the range from $10^3$ to $10^9$ ohm·cm.

5. The semiconductive rubber roller as claimed in claim 1, wherein synthetic resin in said synthetic resin-based composition is an acrylic melamine resin or a urethane resin.

6. The semiconductive rubber roller as claimed in claim 1, wherein said particles of said dielectric material are selected from the group consisting of spherical silica particles, diatomaceous earth and crystalline silica particles.

7. The semiconductive rubber roller as claimed in claim 1, wherein said particles of said dielectric material have an average particle diameter in the range from 0.1 to 30 $\mu$m.

8. The semiconductive rubber roller as claimed in claim 1, wherein an amount of said particles of said dielectric material in said synthetic resin-based composition is in the range from 5 to 60 parts by weight per 100 parts by weight of synthetic resin.

9. The semiconductive rubber roller as claimed in claim 1, wherein said cladding layer has a thickness in the range from 5 to 100 $\mu$m.

* * * * *